United States Patent [19]

Morrison

[11] Patent Number: 4,899,530

[45] Date of Patent: Feb. 13, 1990

[54] DOFFING AND DONNING APPARATUS

[75] Inventor: William A. Morrison, Newtonabbey, Ireland

[73] Assignee: James Mackie & Sons Limited, United Kingdom

[21] Appl. No.: 239,296

[22] Filed: Sep. 1, 1988

[30] Foreign Application Priority Data

Sep. 4, 1987 [GB] United Kingdom ..... 8720842

[51] Int. Cl.[4] ..... D01H 9/00; D01H 9/04; D01H 9/18

[52] U.S. Cl. ..... 57/274; 57/266; 57/275

[58] Field of Search ..... 57/266, 267, 268, 270, 57/274, 275, 299

[56] References Cited

U.S. PATENT DOCUMENTS

| | | | |
|---|---|---|---|
| 3,686,847 | 8/1972 | Vignon | 57/274 |
| 3,791,123 | 2/1974 | Kawauchi | 57/274 |
| 3,841,074 | 10/1974 | Wachendorf et al. | 57/299 X |
| 3,935,699 | 2/1976 | Iida et al. | 57/267 |
| 4,145,868 | 3/1979 | Morita et al. | 57/275 X |
| 4,561,243 | 12/1985 | Gaudino | 57/274 |
| 4,571,930 | 2/1986 | Chiari et al. | 57/270 X |

*Primary Examiner*—Donald Watkins
*Attorney, Agent, or Firm*—Wood, Herron & Evans

[57] ABSTRACT

A yarn spinning, twisting or doubling machine having bobbin doffing and donning apparatus for the spindles of the machine, the apparatus comprising bobbin conveying means extending along and above a row of spindles, a series of bobbin grippers spaced at the same pitch as the spindles, each gripper being mounted for vertical movement between its respective spindle and the conveyor, each gripper being designed to hold or grip a bobbin at a point beyond one end of a package wound on the bobbin so that the grippers can lift the wound bobbin from its spindle for engagement by means on the conveyor and then release the bobbin for subsequent removal, or grip an empty bobbin on the conveyor and move it to its respective spindle and control means operable to move the conveyor after it has received the full doffed bobbins and to bring empty bobbins into line with the spindles so that the grippers can place empty bobbins on the spindles.

This equipment enables the bobbins to be accurately positioned on the spindles and removed from the spindles without the problems which arise from the use of inflatable sleeves.

17 Claims, 13 Drawing Sheets

Fig. 11(INSERT)
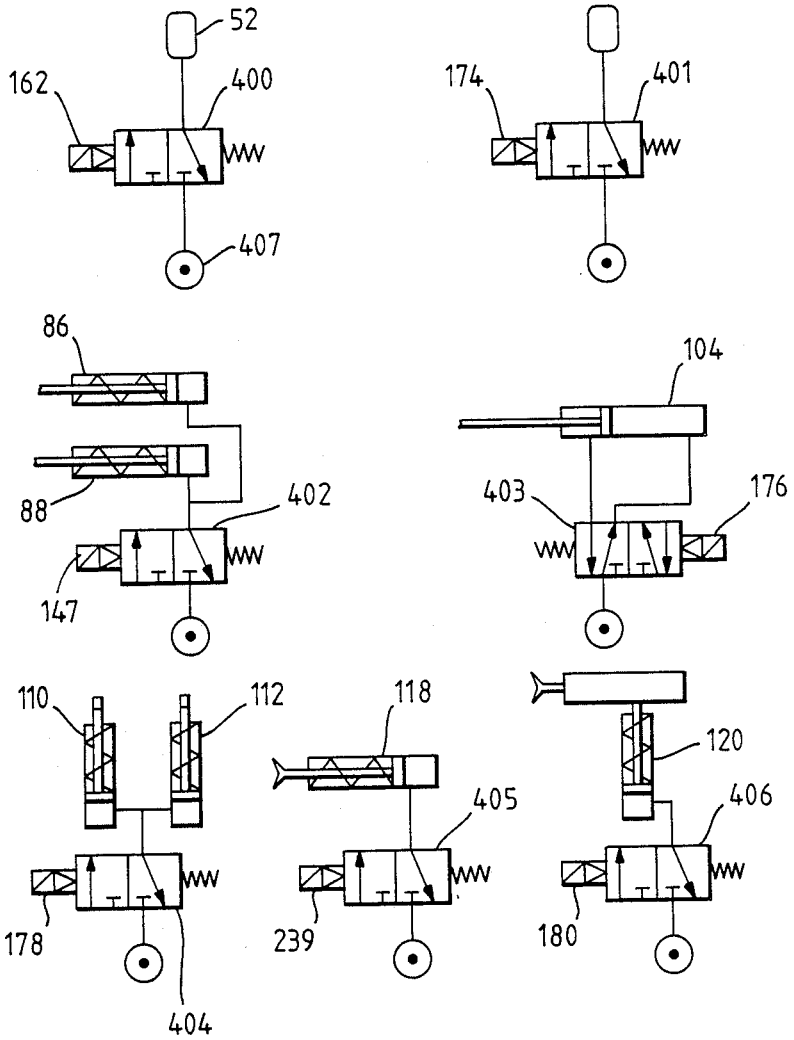

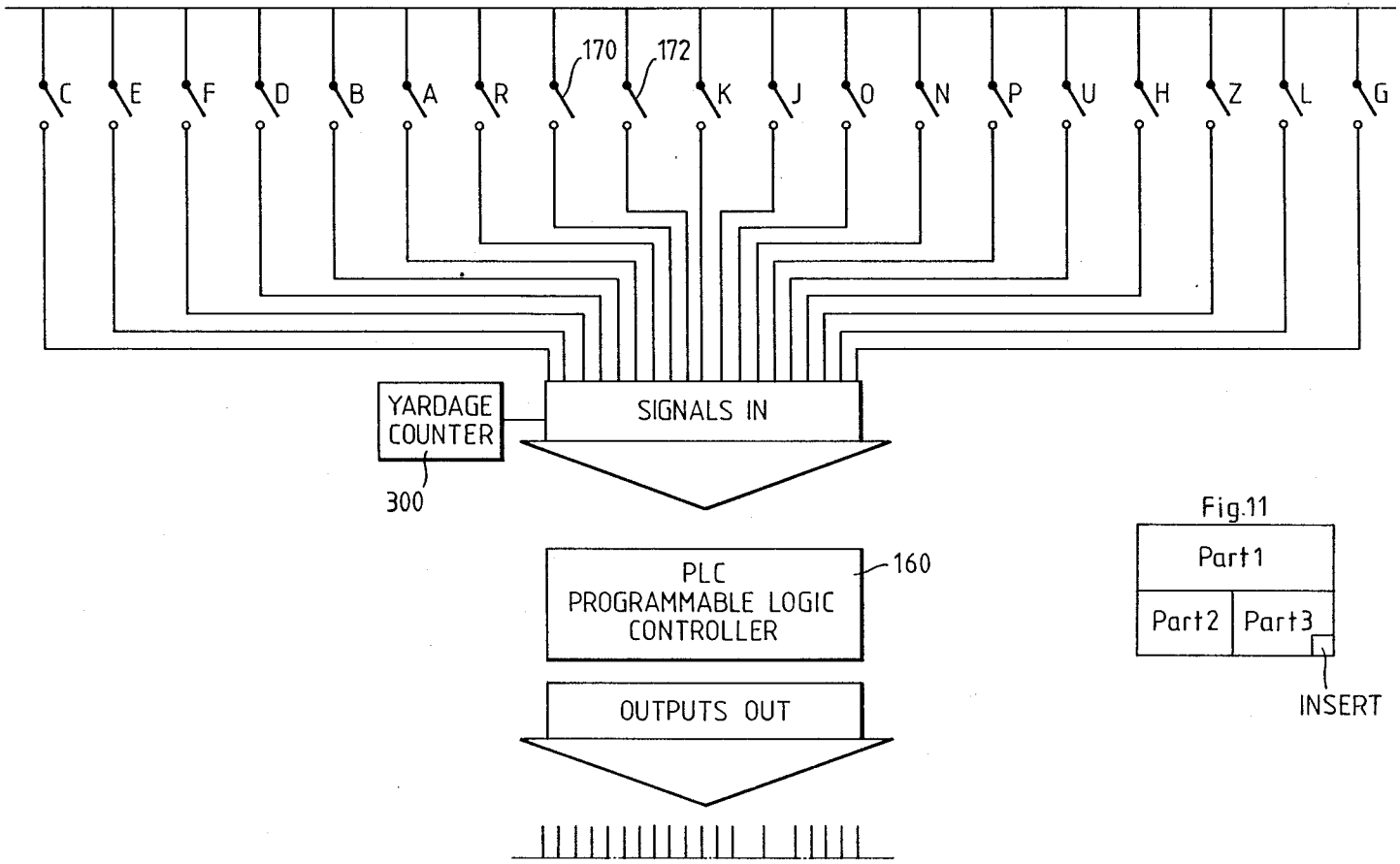
Fig. 11 (part 1)

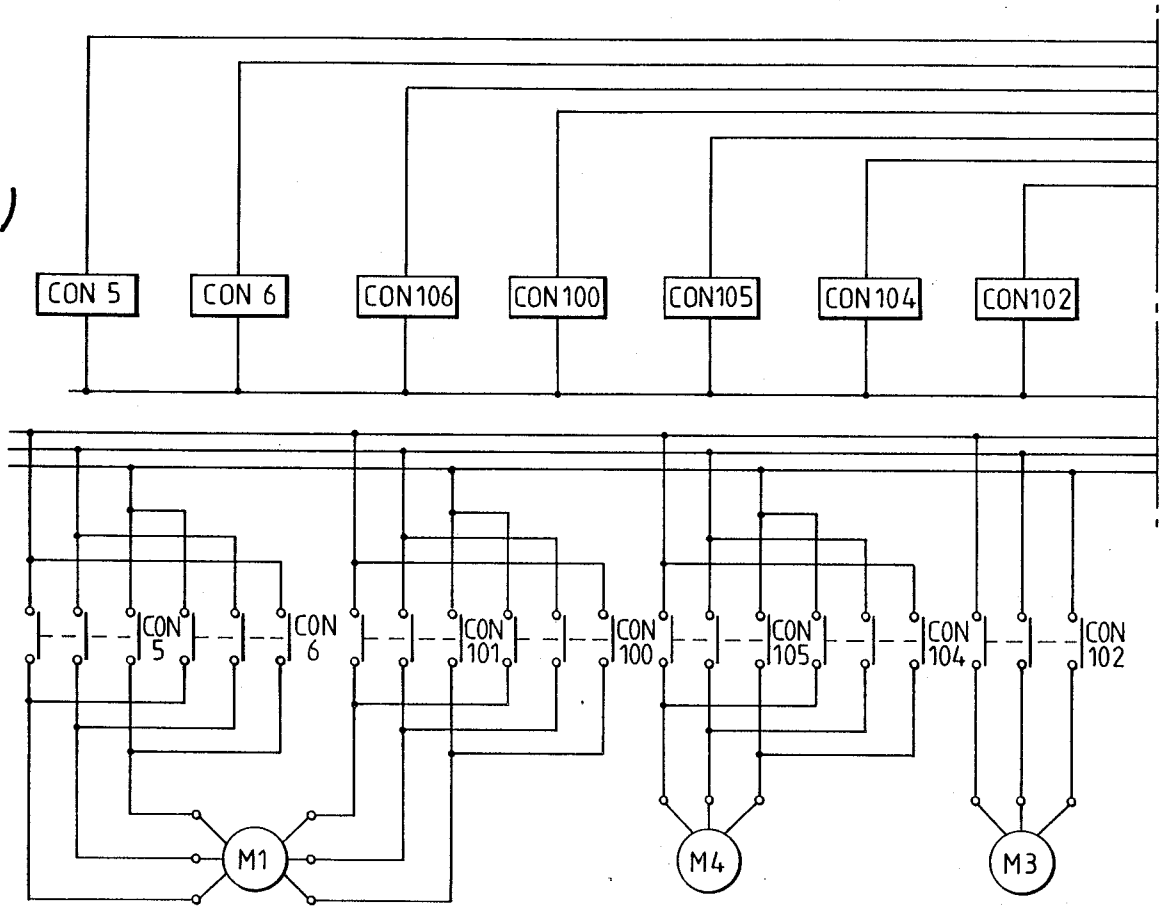
Fig.11 (part 2)

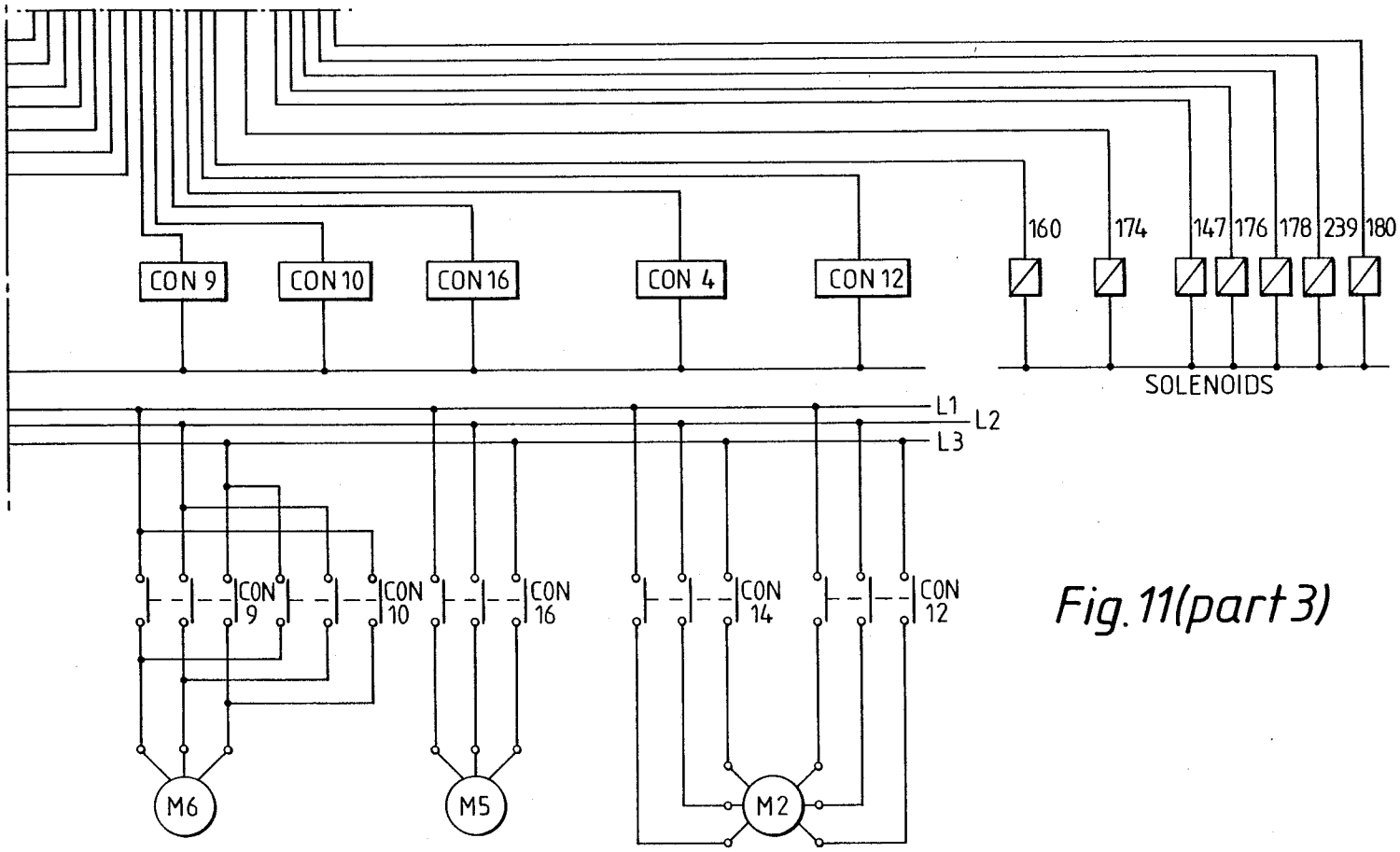
Fig. 11(part 3)

DOFFING AND DONNING APPARATUS

The present invention relates to yarn spinning, twisting or doubling machines and in particular to doffing and donning apparatus therefrom by which a plurality of full bobbins, e.g. a tube, having a yarn package wound thereon, are removed from their respective spinning, twisting or doubling spindles (referred to herein as "twisting spindles") and replaced by empty bobbins (tubes) on which in the next cycle of operation of the machine the yarns are then wound to form the next lot of packages Such "twisting spindles" will hereafter be described as part of a 'ring spinning machine' but it will be understood that that term is used for convenience and that the spindles could also be used on other machines all having a great number of spindles, e.g. in the region of 200 or more, but the apparatus, the subject of the invention is applicable regardless of the number of spindles in the machine.

Automatic doffing and donning devices are known but they are not normally renowned for their reliability and efficiency and particularly as machines are continually increasing in length so as to accommodate more and more spindles, it is not uncommon for the complete doffing or donning cycle to be brought to a halt through the misalignment and jamming of just one or two bobbins out of two or three hundred Some manufacturers have, therefore, tended to rely on small travelling units which are mounted on rails slowly to travel along the machine and which doff only a few bobbins at a time but such apparatus takes a long time to complete the doffing cycle. The present invention relates to doffing apparatus which extends over the working length of the machine, i.e. all the spindles and which operates to doff all of the spindles simultaneously. It should, however, be appreciated that it would be possible to split it into a number of self contained units each operating to doff and donn a given number of spindles and they could be timed if desired, so that each section would operate in sequence, but preferably all the bobbins are doffed and donned simultaneously.

With such apparatus, one of the main problems encountered is alignment and maintaining alignment of the grippers with the spindles. Further and to avoid rigid grippers which if incorrectly set or damaged in operation are then misaligned with the bobbins, there has been an increasing use of inflatable finger-like spigots which when deflated are smaller in diameter than the bore of the bobbin tube and when inflated after being inserted in the bobbin tube, expand to grip the walls of the tube. However, these are not suitable if the spindles on which the bobbin tubes are mounted, are fitted at their top end with anti ballooning extensions which extend upwardly beyond the top of the bobbin tube and around which the yarn being spun is spiralled so as to reduce the co-called yarn balloon resulting from centrifugal forces caused by the high rotating speeds of the spindles and associated travellers.

Therefore, when such anti-ballooning extensions are incorporated in the spindles, it is now fairly common practice to use inflatable sleeves which locate over the actual body of the yarn package and when inflated grip the package itself. However, these limit the package diameters that can be effectively accommodated. Furthermore, whether it be inflatable fingers or inflatable sleeves that are used they all tend to suffer from a common weakness in that in order to be able to generate the necessary considerable retaining forces with the usual pressures, the inflatable sections of the finger or sleeve have to be highly elastic, which in turn means that they have to be suitably thinned walled. As a result in the absence of a bobbin tube or package on the spindle, they are liable to burst. Furthermore, with grippers of this type it is necessary to have a special supply of compressed air to each individual gripper which, in frames having hundreds of spindles, is very expensive as leakages at the junctions must at all costs be avoided if the necessary gripping force to remove the heavy package from the spindle, is to be maintained.

The weight of the yarn package will, of course, influence the effectiveness of the grippers coupled with the fact that the bobbin tubes, which are now normally plastic, sometimes become slightly distorted or damaged and therefore stick on the spindle making it difficult to remove them when they have a full yarn package wound upon them and also to replace the empty tube fully home onto the spindle for the next spinning cycle. The tendency is therefore to use inflatable sleeves which can grip a greater surface area of the yarn package than can the finger-like grippers which ca only grip against a short length of the inside wall of the actual bobbin tube.

However, the use of the inflatable sleeves can give rise to a further problem for because of their bulk, in particular their outer diameter, the axis of the spindles have to be further displaced outwardly from the nip, of the delivery rollers from the drafting zone (i.e. the distance from a vertical line projected downwardly from the nip of the delivery rollers and its associated pressing roller, to the vertical axis of the spindle upon which the bobbin is located, must be increased) in order to allow the inflatable sleeves to clear the delivery rollers as they are lowered and raised to doff the full packages from their spindles. This alters the angle that the yarn must make as it leaves the yarn guide eye of the lappet just above the spindle, which guides the yarn onto the spindle extension or direct to the traveller on the ring. If the angle departs too much from the vertical it can result in preventing the yarn twist from running right up to the nip of the delivery rollers as it blocks at the lappet and this results in an increase in the number of yarn (end) breaks that will occur during spinning.

In order to avoid increasing the angle of the yarn from the vertical, some machine manufacturers have significantly increased the vertical distance between the delivery rollers and the top of the spindle so that they can design the auto doffing device to move up and down past the delivery rollers without fouling them and once below the level of the rollers the gripper devices then moves inwardly until they are directly above the spindles and then downwardly again to locate over and grip the packages on the spindles. When removing (doffing)the bobbins from the spindles, the apparatus then must perform that stepped action in reverse. However, not only does this lead to a requirement for a much more sophisticated doffing and donning apparatus which, in turn, adds to the risk of misalignment during construction or resulting from damage, but the longer length of unsupported yarn that results from the increased vertical space between the delivery rollers and the top of the spindles also leads to an increase in yarn breaks.

The present invention is directed at providing an uncomplicated doffing and donning device without the attendant disadvantages mentioned above.

Such an automatic bobbin doffing and donning apparatus for the spindles of a textile machine in accordance with the invention comprises, for each spindle, a bobbin gripper which is designed to move vertically and pass over the end of the bobbin firstly to hold it at a point beyond one end of the wound package and then to lift the full bobbin from the spindle and subsequently to place an empty bobbin on the spindle.

Each gripper is preferably in the form of arms or fingers or the like designed to be movable from an open to an operative position in which they grip or hold a neck portion of a bobbin. The bobbins to be doffed from the spindles may have an elongated neck possibly of reduced diameter, terminating in an annular collar, the fingers of the gripper engaging beneath the collar.

Each gripper may have two arms pivotally connected at one end, the other end of the arms being designed in the operative position to be face to face, the faces or at least the outer ends of the faces, in use, preferably being angled to the vertical to help to prevent yarn extending from the bobbin, being inadvertently caught by the gripper.

The grippers may be arranged so as firmly to hold the bobbin so as correctly to align it with the twisting spindle and conveyor spigot. Alternatively the gripper may be positioned loosely in the recess at the neck of the bobbin so that the bobbin can take up its own vertical position by gravity to compensate for slight misalignment of the grippers.

The full bobbins after doffing from the spinning spindles are preferably moved from the grippers by a common conveyor, which conveyor also acts to convey empty replacement bobbins to the grippers. The bobbins may be mounted on the conveyor by spigots protruding from the conveyor and engaged in the axial hole in the top of the bobbins.

In one arrangement the doffed full bobbins are moved by the conveyor until they are positioned extending upwardly from the upper run of the conveyor while the replacement empty bobbin tubes extend downwardly, in line with the spindles, from the bottom run of the conveyor. After the empty tubes have been automatically placed (donned) on the respective spindles the conveyor is run to move the full bobbins to one end of the machine where they are unloaded in groups from the conveyor onto palettes which can then be taken to the next machine stage in the yarn process, or for packaging for supply to customers.

When the full bobbins have been unloaded from the conveyor it is then automatically loaded with empty tubes and when the requisite number are loaded, i.e.—equivalent to the number of twisting spindles, the conveyor is run until they are all or substantially all disposed along the top run of the conveyor with the empty spigots along the bottom run in line with the spinning spindles in readiness for the next doffing cycle.

The apparatus for unloading the full bobbins from the conveyor may operate similarly to the device described above for Auto Doffing and Donning, the full bobbins being removed in groups by grippers and lowered onto pallets or into hoppers or trucks or onto a further conveyor to be taken away from the machine. The machine may have already commenced the next spinning cycle during the unloading of the full bobbins from the conveyor.

A reservoir for empty bobbins may be provided together with means for supplying these bobbins to a loading conveyor which is arranged to position the bobbins for location on the spigots of the main conveyor, means also preferably being provided to engage the bobbins and thus to move the empty bobbins from the loading conveyor to the spigot of the main conveyor.

Sensing means may be provided to ensure that the correct end of the bobbin is adjacent to the spigot of the main conveyor.

Fingers or the like are preferably provided to engage, at the appropriate point in the Auto doffing and donning cycle, each empty bobbin, to seat it fully home on a twisting spindle. They may also engage the full bobbin prior to it being doffed from the twisting spindle so as to raise it on the spindle and break the frictional bond between it and the twisting spindle.

The invention will now be further described by way of example with reference to the accompanying drawings in which.

Figure 1:
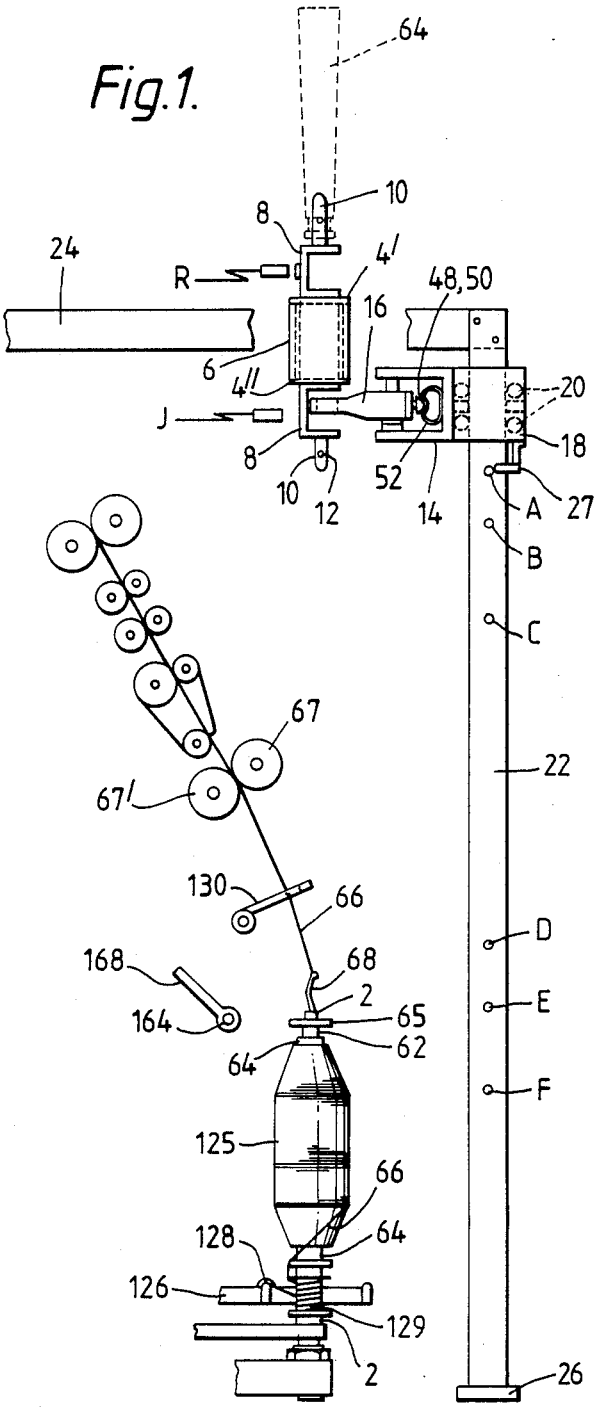
FIG. 1 is an end view of the front of an example of a ring spinning machine in which the drawing head is represented by some rollers and aprons. The auto doffing and donning apparatus is to the front of the machine.
Figure 3:
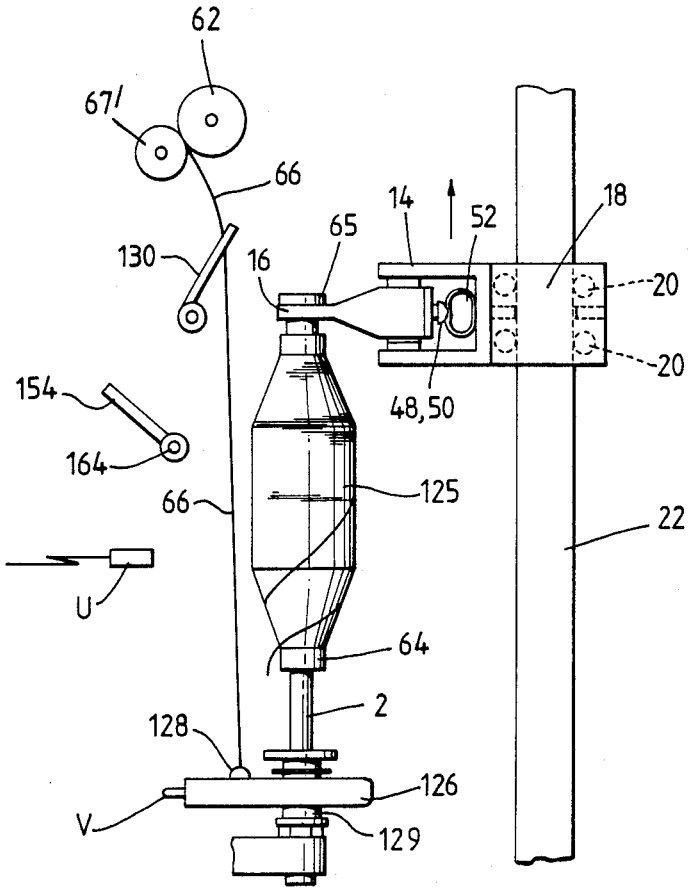

FIG. 3 corresponds with the lower part of FIG. 1 but shows the auto doffing and donning apparatus in the course of lifting the full packages off the spinning spindles.

Figure 4A:
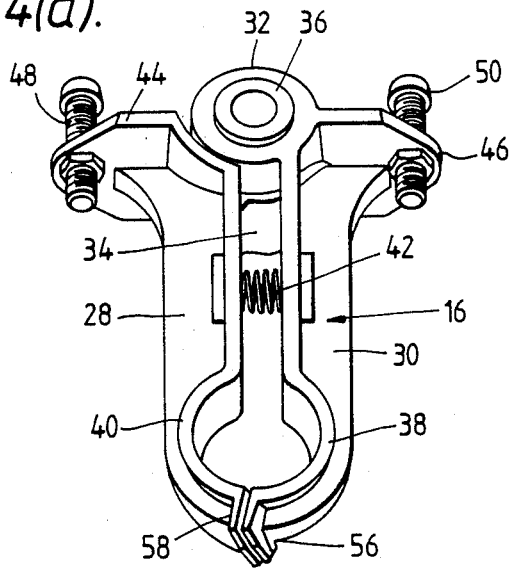
Figure 4B:
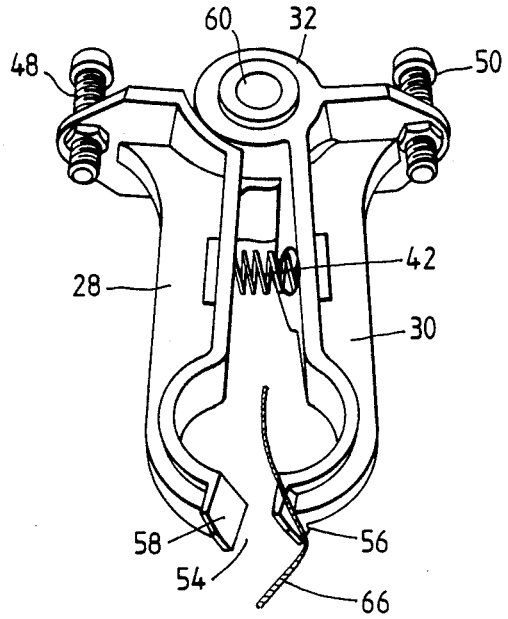

FIGS. 4 (*a*) and 4 (*b*) illustrates a bobbin gripper in the inoperative and operative positions respectively.

Figure 5:
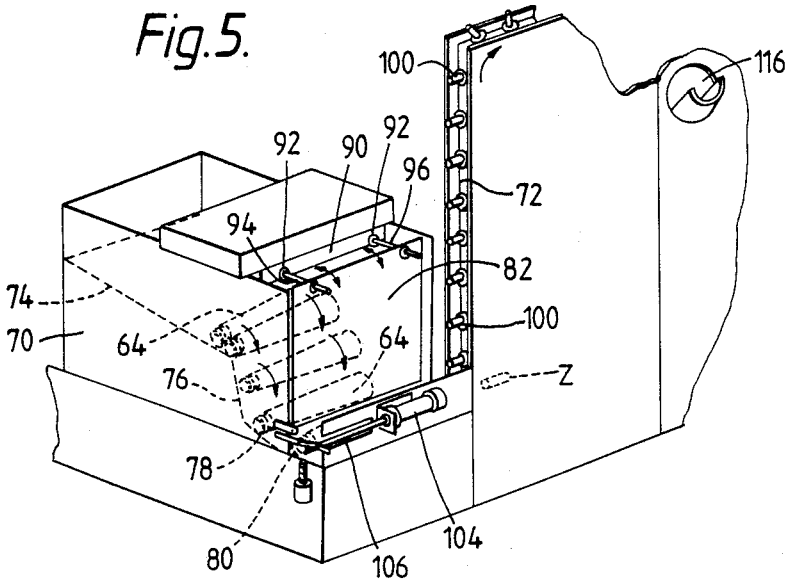

FIG. 5 is a perspective view of the lower end of the auto bobbin tube loader vertical conveyor and the hopper into which the empty bobbin tubes are loaded in readiness for positioning on the spigots of the vertical conveyor.

Figure 6:
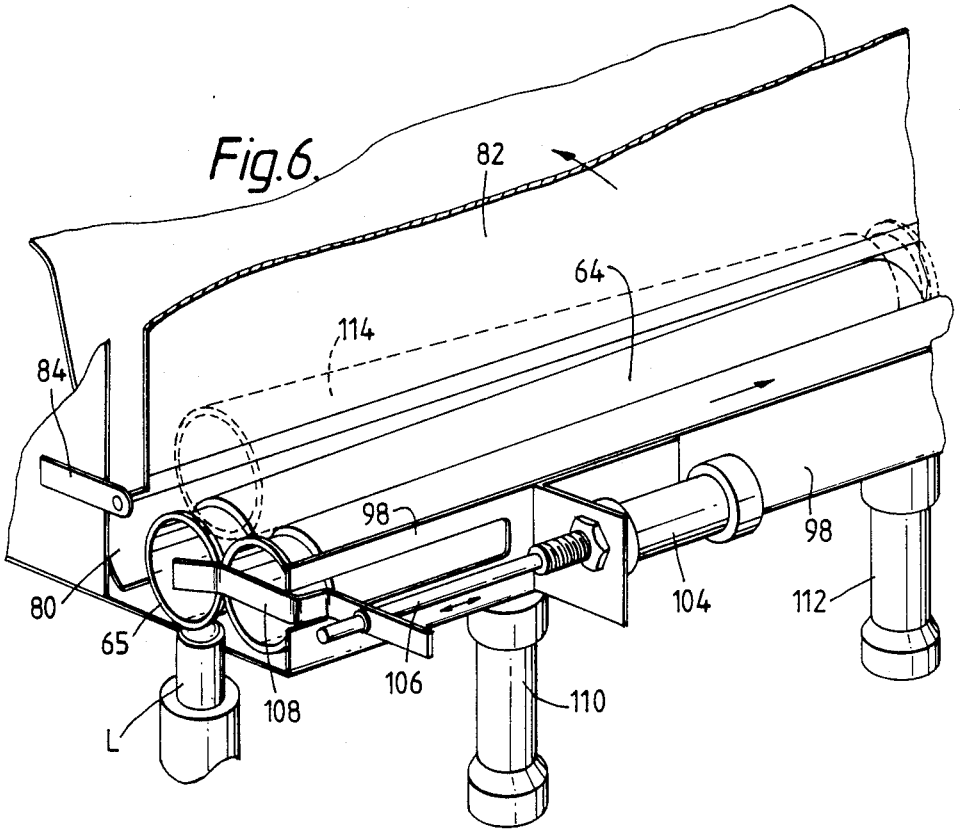

FIG. 6 is a perspective view of the exit of the hopper showing the detector mechanism for detecting if the tubes are lying with their correct end adjacent the auto loader.

Figure 7:
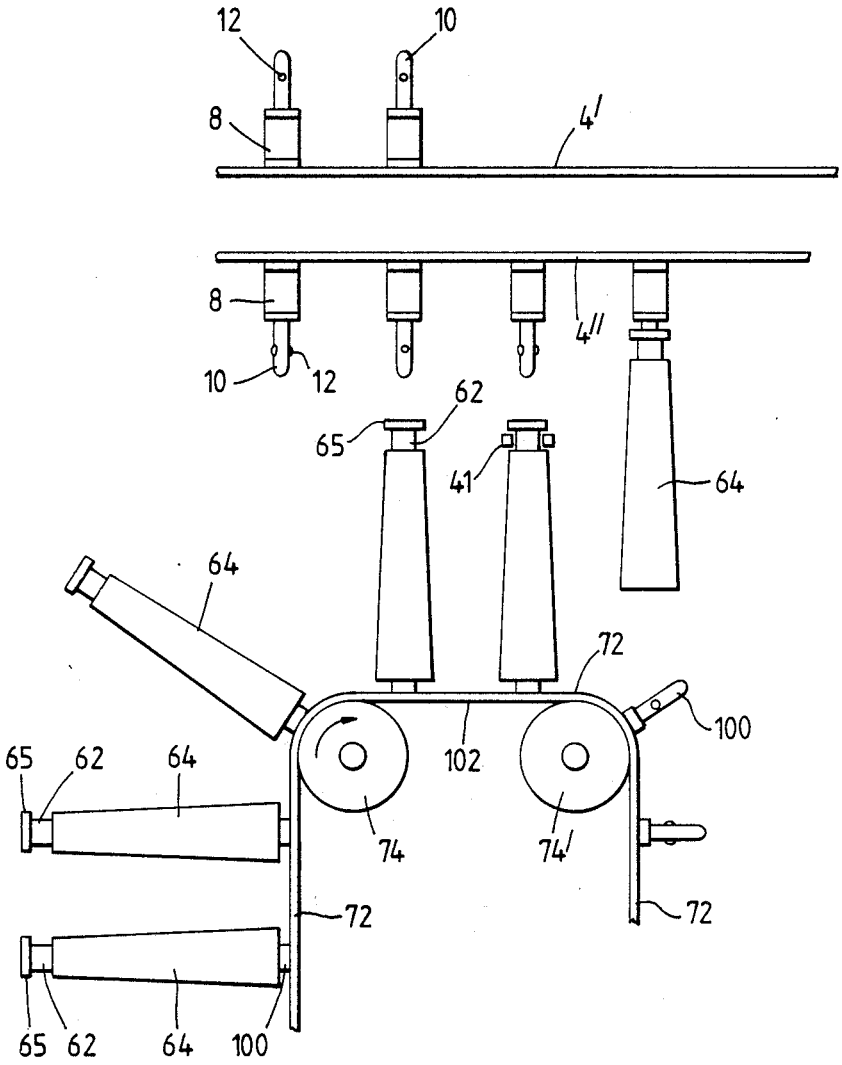

FIG. 7 is a front view of a short length of the top conveyor and the upper end of the auto bobbin tube loader and vertical conveyor.

Figure 8:
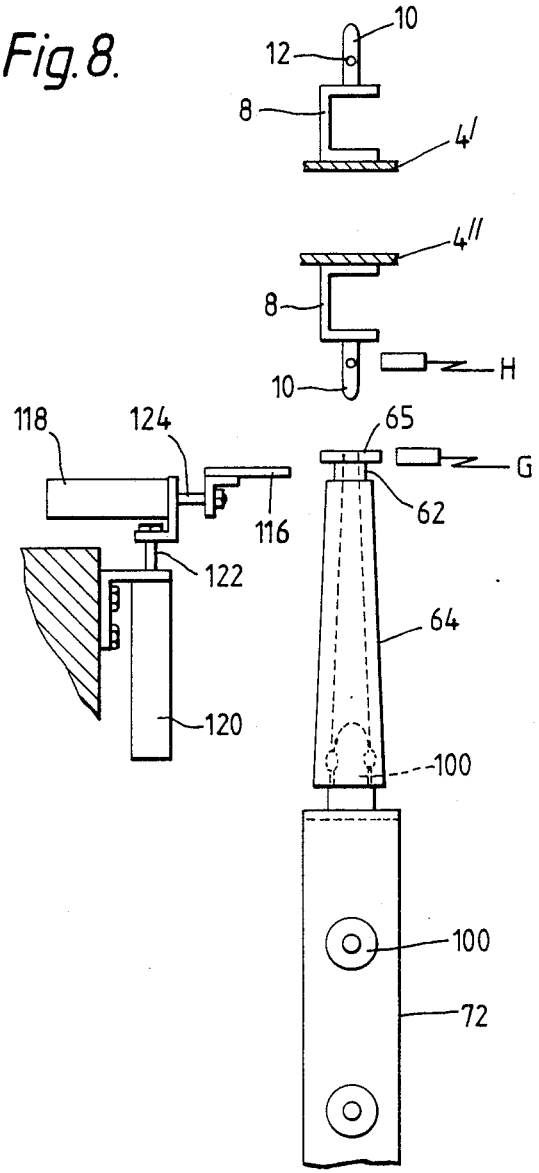

FIG. 8 is a detail view of part of FIG. 4 showing the bobbin tube lifting mechanism in greater detail.

Figure 9:
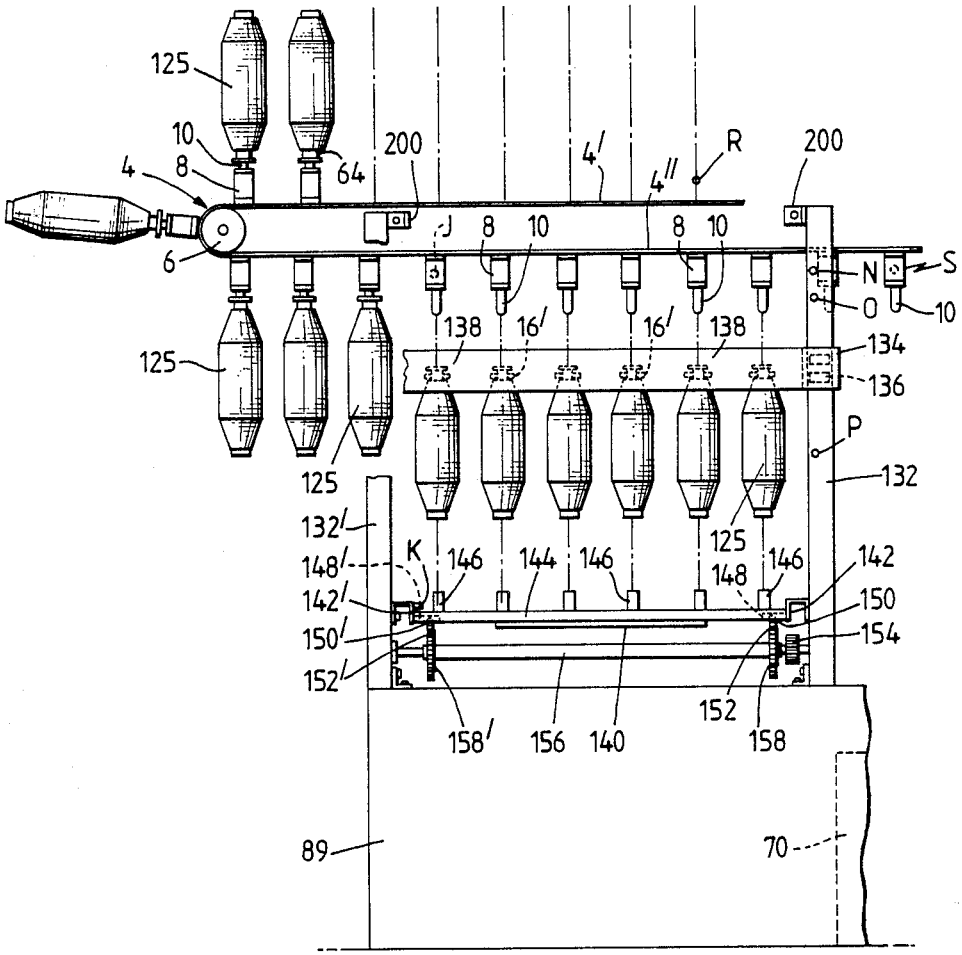

FIG. 9 is a front view of the bobbin unloading device which removes the full bobbins from the top conveyor holding spigots.

Figure 10:
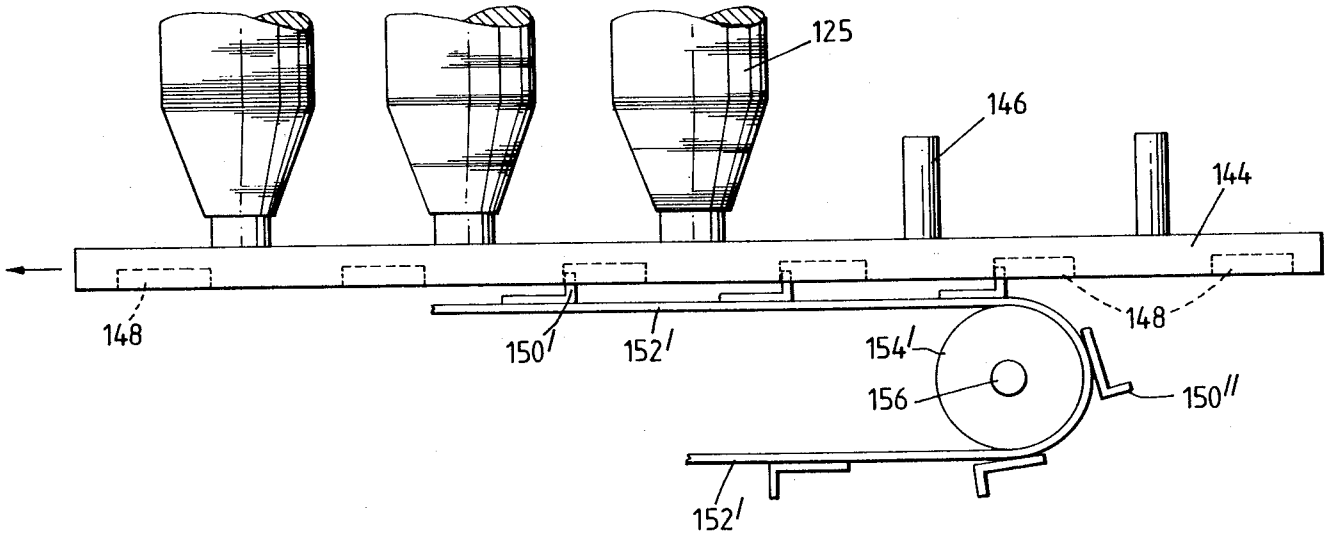

FIG. 10 is an end view of the pallet indexing mechanism of the bobbin unloading device.

FIG. 11 is a circuit diagram of the auto doffing and donning device including the bobbin tube loader and full bobbin unloading device.

Figure 2:
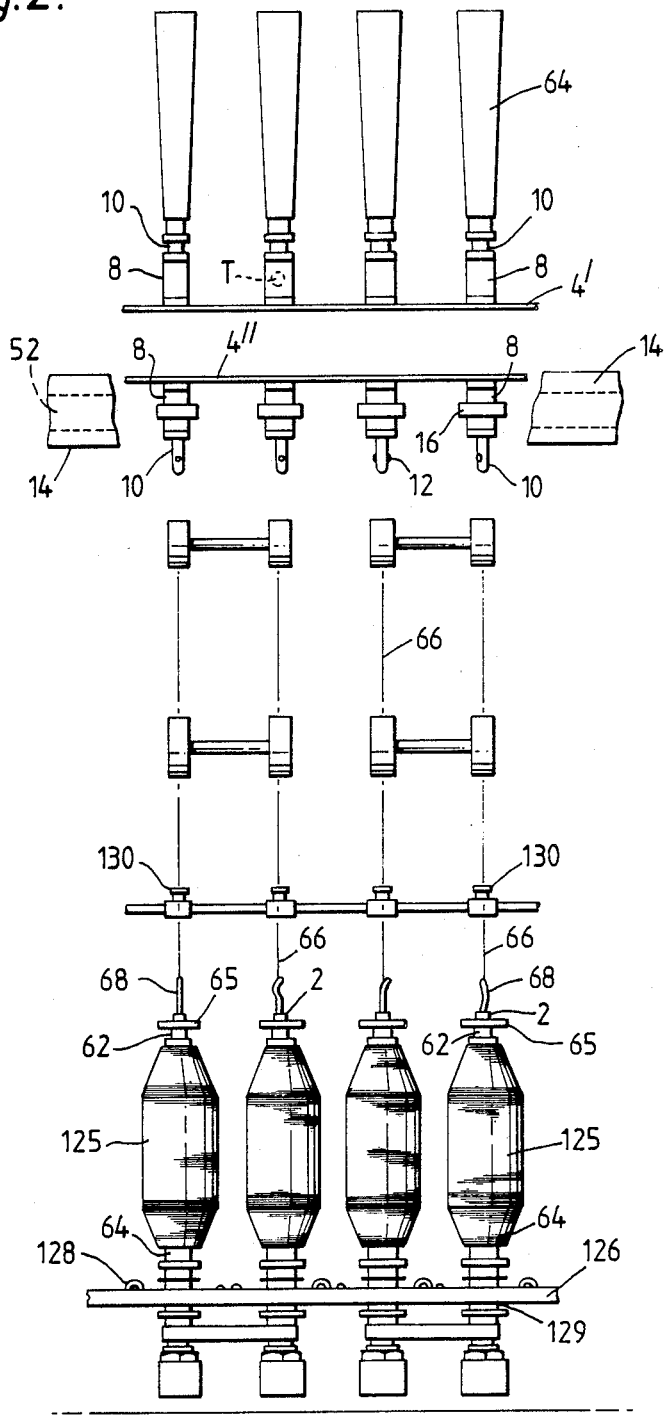
FIG. 2 is a front view of a section (length) of part of the machine corresponding generally with the mechanism illustrated in FIG. 1.

Referring to FIGS. 1, 2 and 3, extending along the top of the machine in line with the "twisting" spindles 2 is a horizontal main conveyor 4 which is mounted between supporting guides (not illustrated) so that its runs remain taut and horizontal. The conveyor is driven by sprockets 6 which can be driven by a motor M2, illustrated only in FIG. 11, so as, when required, to drive the conveyor in an anticlockwise direction. Carried on the conveyor are channel shaped brackets 8 to which are fixed short bobbin holding spigots 10 which have spring loaded gripping buttons 12 in their walls so as to spring outwardly beyond the diameter of the spigot to grip the inside of the wall of the bore of the bobbin tube. The inside wall of the bobbin tubes may be recessed to accommodate the button when it springs outwardly. The spigots are pitched along the conveyor 4 at the same pitch as the twisting spindles 2 and when the conveyor is stationary during the doffing of the full bobbins from the spindles they are synchronised so as to be in line with the twisting spindles. However the conveyor extends beyond the total span of the spindles so as to co-operate with a full bobbin unloading device and an empty bobbin tube loader both of which, conveniently, may be located at the same end of the machine.

There are twice the number of spigots than twisting spindles as they extend almost fully around the top and bottom runs 4' and 4'' of the conveyor.

Parallel with the conveyor 4 is a support rail 14 which carries grippers 16 each in line with a respective twisting spindle 2, there being approximately two hundred spinning spindles and a corresponding number of grippers. The support rail 14 is mounted upon slide brackets 18 which contain runners 20 that locate against the side of vertical pillars 22, suitably and rigidly mounted on the frame of the machine by means of tie bars 24 at their upper end and rails 26 at their lower end. There are a number of such pillars 22 spaced along the length of the machine. The support rail 14 and hence the grippers 16 can be driven by a motor M1 (FIG. 11) through a toothed belt and pulley arrangement (not illustrated) to lower and rise towards and away from the spinning spindles 2. It will be appreciated that the rail 14 may comprise a number of lengths tied together. The movement of the support rail 14 down and up the vertical pillars is controlled by way of a series of sensors A, B, C, D, E, and F, which detect the passage of a locator finger 27 fixed to the support bracket 18.

FIG. 4(*a*) and (*b*) illustrate the gripper 16. It comprises two arms 28 and 30 at one end of each is a boss 32, 34 which interlock and through which passes a bush 36 so as to hold it together as an assembly. At the opposite end of each arm is a semicircular gripper portion 38, 40 which when the gripper is in the closed operative position, as illustrated in 4 (*a*), virtually forms a circle. The arms are urged apart by a spring 42 but extending from their respective boss portions are extensions 44, 46 in which are mounted dome headed screws 48, 50 the position of which can be adjusted. When the grippers are mounted in the support rail 14 these dome headed screws 48, 50 abut against an inflatable hose or series of hoses (as shown in FIG. 1) 52 which extend along the inside of the rail 14 and are connected to a pneumatic source so that when the tube 52 is inflated it forces the gripper arms 28, 30 towards each other to close the gripper. Inversely, when the hose is deflated the spring 42, forces the gripper arms apart to open the gripper. Electro magnets may, for example, replace the inflatable tube.

The entrance 54 into the gripper is formed between two angled walls 56, 58 one on each of the gripper arms 28, 30 the angle being such that the plane of the walls cuts across the vertical axis 60 about which the arms pivot so as to open and close. The purpose of this is illustrated in FIG. 4 (*b*). When the rail 14 is lowered so that the gripper can grip the reduced diameter top 62 of the bobbin tube 64, the gripper must be opened to enable it to pass over the rim 65 of the bobbin and it is important that the length of yarn 66 which extends from the delivery rollers 67, 67' to the top of the spindle and which is lying limp, the twisting spindle being stopped, does not inadvertently get into the gripper to be caught along with the bobbin tube when the gripper closes, as this could break the yarn and become entangled with the auto doffing apparatus. Therefore, to prevent this, the entrance lies at an angle to the vertically hanging yarn with the result that it will not easily enter the small gap 54 at the entrance to the gripper but, instead, as the gripper opens will be pushed to one side as illustrated in FIG. 4 (*b*). This is an important feature as it solves what was a fairly regular source of trouble. The bobbin tube 64 which is usually plastic and diverges slightly from top to bottom, has a projection, or projections, preferably in the form of a rim 65 and a recess 62 the upper wall of which is represented by the rim which, for reasons which will become apparent is, most advantageously, metal. Mounted on the top of the spindle 2 so as to extend upwardly above it, is an anti-ballooning finger 68. The bore of the bobbin tube is sufficiently large to clear this finger when the tube is being doffed or donned.

As seen in FIGS. 5 and 6 the automatic bobbin tube loading apparatus comprises a bobbin tube magazine (hopper) 70 which is positioned at the left hand side of the machine adjacent to the full bobbin unloading device, the left hand side of the hopper being shown in FIG. 9. The hopper co-operates with a vertically disposed conveyor 72 (see also FIG. 5) which delivers the tubes to bobbin tube lifting apparatus which pushes the tubes onto the spigots 10 of the conveyor 4.

The hopper 70 (see FIG. 5) has a gently downwardly sloping base 74 at the end of which is a steeply inclined wall 76 followed by a more gently inclined section 78 which leads to the exit 80. Beyond the wall 76 is a substantially vertical plate 82, the distance between the wall 76 and the plate 82 being just wide enough to accommodate only one tube so that they will fall down towards the exit one at a time. The plate 82 is pivotally mounted at each side at the bottom of the hopper in brackets 84 (see FIG. 6) and at its top end is connected to pneumatic cylinders 86, 88 seen only in FIG. 11, on the rear side of a support bar 90 which has holes 92 through which the pistons 94, 96 of the cylinders 86, 88 protrude to be connected to plate 82. The cylinders 86, 88 are controlled so as to reciprocate the plate 82 about its lower pivots hence preventing any build up or jamming of the tubes 64 in he substantially vertical passage towards the exit of the hopper.

After a tube has fallen down the passage between wall 76 and reciprocating plate 82 onto the more gentle slope 78 it passes through the exit 80 and lies against a stopper plate 98 which aligns it with the spigots 100 on the vertical conveyor 72. However, it is important that the tube is lying with its bottom end (i.e. the end without the rim 65) adjacent to the vertical conveyor for as will be observed from FIG. 8, when the vertical conveyor reaches its upper horizontal run 102 so that it moves horizontally and parallel with the conveyor 4 with which it is aligned, then it is necessary for the end of the tube 64 on which the rim 65 is fixed to be pointing upwardly.

In order to ensure that a tube 64 is positioned in the hopper with its rim 65 remote from the vertical run of the conveyor 72 next to the hopper, a metal detector sensor L is positioned at the left hand side of the exit of the hopper 70 remote from the conveyor 72 and adjacent the stopper plate 98 so as to be in close proximity with the metal rim 65 of the tube provided that the tube is lying the correct way around. When a signal is received from the metal sensor L indicating the presence of the ring, and a signal is also received from a sensor Z, which is mounted on a support plate of the conveyor 72 aligned with the exit 80 of the hopper, when a spigot 100 moves into line with the exit and sensor Z signals the conveyor to stop. A pneumatic cylinder 104 then operates to retract its piston 106 to which is connected a pusher 108 to engage the end of the tube and push it towards the conveyor 72 and onto a spigot 100. The conveyor 72 then restarts and brings the next spigot 100 into line with exit 80 of the hopper whereupon the pneumatic cylinder 104 is again operated to push the next tube towards the conveyor 72 and onto the spigot provided that the rim 65 of the tube is positioned remote from the conveyor 72 and the appropriate signal is received from sensor Z.

However, in the event that a tube 64 has been loaded into the hopper 70 the wrong way around then the sensor L will not detect the metal rim 65 and instead of the cylinder 104 operating, another pair of cylinders 110, 112, positioned directly below the tube lying against the stopper plate, 98, will be operated and their pistons will move upwardly through holes in the bottom plate of the hopper on which the offending tube rests so as to push it up out of the loading position and the next tube will then move through the exit to rest against the pistons so that when they withdraw, it will roll into position in readiness for loading. The discarded tube 114 may ride on top of the two below it, as seen in FIG. 6 and may be removed by hand at the convenience of the operator and placed in a chute 116 (FIG. 5) which leads to a collecting bin, not shown, from which they can be subsequently correctly loaded into the hopper 70.

Another detector G (see FIG. 8) is positioned at a convenient point along the horizontal path of the tubes located on the spigots 100 along the top run 102 of conveyor 72 so that as each tube passes its presence is detected and the conveyor 72 is stopped in line with bobbin tube lifting mechanism 116, 118, 120 (see FIG. 8). The conveyor 4 is also controlled by a further sensor H positioned along the path of the downwardly projecting spigots 10 on the bottom run 4'' of the conveyor 4 so as to signal the conveyor 4 to stop during the bobbin tube loading cycle when a spigot 10 is aligned with the bobbin tube lifting mechanism 116, 118, 120 and the adjacent bobbin tube, on the top run of conveyor 72.

With reference to FIGS. 7 and 8, the bobbin tube lifting mechanism comprises a pneumatic cylinder 118 which is mounted on the end of the piston rod 122 of cylinder 120 at right angles to piston 122. Fixed to the end of piston rod of cylinder 118 is a bifurcated member 116 which is shaped so as to accommodate the neck portion 62 of the bobbin tube 64. When the bobbin tube is to be transferred from the vertical loading conveyor 72 to the main top conveyor 4, the pneumatic cylinder 118 extends its piston 124 so as to locate the bifurcated member 116 in the groove (neck) 62 of the opposite bobbin tube whereupon the cylinder 120 operates to lift the tube off its spigot 100 and push it onto the aligned spigot 10 of conveyor 4. The cylinder 118 then operates to retract the bifurcated member 116 and the cylinder 120 to lower cylinder 118 to the inoperative position shown in FIG. 8. The vertical conveyor 72 and top conveyor 4 then move one pitch to bring the next spigots 100, 10 respectively, into line with the bobbin tube lifting mechanism and the sequence is then repeated.

When the apparatus has reached the point in its cycle as seen in FIGS. 1 and 2, the wound packages 125 have reached the required size (e.g.yardage), the twisting spindles 2 stopped and the standard ring rail 126 and travellers 128 lowered to the bottom position. The underwinds are wound onto the reserve winding member of the spindle and the yarn 66 severed between the full package and the reserve winding member 129 at the bottom of the spindle. Such an operation is described in our co-pending British Application Number 8719416.

At this stage, as is common, the lappets 130 with their yarn guides will be pivoted anticlockwise from the position illustrated in FIG. 1 to the position shown in FIG. 3 so as not to obstruct the downward passage of the grippers 16 and the upward doffing of the full bobbins (packages) 125. Prior to the completion of the spinning operation, the conveyor 4 will have moved to such a position that the empty spigots 10 along its bottom run 4'' will be aligned with the spinning spindles 2 while the spigots carrying the empty bobbin tubes will be along the top run 4' of the conveyor with the empty bobbin tubes extending upwardly from it.

In operation the grippers 16 are lowered in a closed state and then opened to pass over the top rim 65 of a wound bobbin. The gripper arms then close around the portion 62 of the bobbin and the held bobbin is then lifted off the twisting spindle by the grippers and pushed onto the aligned empty spigot 10 of the conveyor 4. The gripper arms are then opened and moved to the "park" position so as to allow the conveyor to move the full bobbins away and bring the empty bobbins into line with the twisting spindles.

As is illustrated in FIGS. 9 and 10, the bobbin unloading device is located at one end of the machine beyond the end spinning spindle 2 and adjacent to the bobbin tube loading apparatus, the left hand side of the bobbin tube loading hopper 70 being shown in FIG. 9. The top conveyor 4 also extends beyond the end spinning spindle so as to pass above the full bobbin unloading device which comprises pillars 132, 132' which support, for up and down movement on brackets 134 and runners 136, a rail 138 which carries a number of grippers 16' (e.g. six). The support rail 138 and grippers 16' are operated in the same manner as the doffing rail 14 and grippers 16 of the auto doffing and donning device. Only in this instance the vertical movement of the support rail 138 and operation of the grippers are controlled by sensors N, 0, P on pillar 132, as shown in FIG. 9. Because of the extended length of the conveyor 4 a short length of the conveyor may not carry spigots 10.

Positioned below the support rail 138 and grippers 16' on a support table 140 and between guides 142, 142' is a pallet 144 which as shown in FIG. 9 has a row of bobbin locating pins 146 corresponding to the number of grippers (e.g. six) on the unloading rail 138. As seen in FIG. 10 which is an end view of the pallet it has a number of such rows of pins, e.g. five, so that each pallet may hold thirty bobbins. Instead of pins the pallet may be formed with circular recesses in which the bobbin bases would locate.

The underside of the pallet 144 has recesses 148, 148' at each side which are pitched to coincide with the pitch of the bobbin support pins. These recesses cooperate with pushers 150, 150' which are mounted on endless toothed belts 152, 152' at each side below the pallet which are driven by a motor M3 (FIG. 11) which drives a toothed pulley 154 on a shaft 156 upon which are mounted toothed wheels 158, 158' which drive the belts 152, 152'. When the motor M3 is started it drives the belts 152, 152' which in turn push the pallet in the direction of the arrow shown in FIG. 10, the pushers 150,

150′ engaging the front faces of the recesses 140 in the underside of the pallet.

A sensor K (FIG. 9) is positioned at one side of the pallet so as to cooperate with a locator on the end pin of each row of bobbin pins on the pallet and each time a new row of pins comes into line with the sensor K it signals the motor M3 to stop driving the pallet so that it is stationary while the full bobbins are unloaded from the conveyor 2 onto it.

The doffing and donning cycle including the removal of the doffed full bobbins from and loading of the empty bobbins onto the auto doffing apparatus will now be described with particular reference to FIG. 11.

STAGE 1

(i) When the spinning cycle is completed and the required yardage wound onto the packages, a yardage counter 300 provides a signal to a programmable logic controller (microprocessor) 160 to start the pre-programmed auto-doff sequence. The microprocessor 160 sends an output voltage to contactor con 6 and so start the motor M1 to drive the doffing rail 14 down from its stationary 'park' position higher than the spigots 10 along the bottom run of conveyor 4.

(ii) When the locator finger 27 on the doffing rail 14 reaches sensor C the sensor signals the microprocessor which, in turn, sends an output voltage to solenoid 162 of a 3-port spring return pneumatic valve 400 (shown in Inset of FIG. 11) which is connected to a compressed air supply 407 to inflate tube 52 to close the grippers 16 so as to prevent the yarn between the delivery roller and the top of the package entering the gripper.

(iii) Doffing rail 14 continues down to sensor E so as the grippers are just above the spindles which provides a signal to the microprocessor which then stops sending the output voltage to contactor con 6 and so stops motor M1 (and descent of rail). The microprocessor simultaneously stops outputting a voltage to the solenoid 162 and tube 52 deflates through valve 400 thereby opening the grippers to permit them to pass over the rims 65 of the respective bobbin tubes.

(iv) After a slight pause as pre-set in the microprocessor program, the microprocessor sends an output voltage to con 100 to start motor M1 in the same direction as step (1), this time at a slower speed and the doffing rail starts to descend again at the slower speed to pass the grippers over the heads of the bobbin tubes, to sensor 'F' which signals the microprocessor to stop sending an output voltage to contactor con 100 and so stop the motor M1 and hence the descent of the doffing rail.

(v) On receipt of the signal from sensor 'F' the microprocessor also sends an output voltage to solenoid 162 of valve 400 to inflate tube 52 to close grippers 16 around the necks 62 of the respective bobbin tubes and pause to permit full inflation, the duration of the pause being pre-set in the microcomputer program.

(vi) The microprocessor 160 next sends an output voltage to contactor con 5 which causes motor Ml to start in the opposite direction and so doffing rail 14 reverses and moves up to doff the full bobbins from the spindles at the faster speed setting to sensor 'D' which signals the microprocessor to stop sending an output voltage to contactor con 5 and so stops motor M1 to permit a visual check by the operator that all yarn ends are cut.

(vii) After a pause, again as determined by the program in the microprocessor to permit the visual check of cut ends, the microprocessor outputs a voltage to contactor con 5 so that motor M1 restarts and doffing rail moves up at the fast speed to sensor C. On receipt of a signal from sensor C, the microprocessor stops outputting a voltage to contactor con 5 and instead outputs a voltage to contactor con 101 thereby causing motor M1 to continue at the slow speed setting (without stopping) so as to more gently locate the full bobbins on empty spigots 10 of conveyor 4.

(viii) When the doffing rail reaches sensor B, a signal is sent to the microprocessor which stops outputting a voltage to contactor con 101 and so stops motor Ml. On receipt of the signal from sensor B the microprocessor also stops sending an output voltage to solenoid 162 of valve 400 to exhaust tube 52 and open the grippers 16.

(ix) After a pre-programmed slight pause at sensor B to allow tube to be fully exhausted to ensure that the grippers are open, the microcomputer outputs a voltage to contactor con 101 again so that the doffing rail 14 moves up at the slow speed to the park position at sensor A which signals to the microprocessor to stop sending an output voltage to contactor con 101 and so motor M1 stops.

(x) Simultaneously the microprocessor outputs a voltage to contactor con 14 to start motor 'M2' which drives the top conveyor 4 counter clockwise at fast speed to the empty tube position—i.e. so that empty tubes extend downwardly from bottom run 4″ of top conveyor 4 and are aligned with the spinning spindles 2. The conveyor motor M2 is stopped in this position when a sensor 'R' positioned along the path of the top run of the conveyor 4 detects a co-operating locator 'S' on one of the brackets 8 which is so positioned as to align the spigots carrying the empty tubes with the spinning spindles. The signal from sensor R stops the output voltage from the microprocessor to contactor con 14 so as to stop the conveyor 4 in this position.

(xi) At the same time that motor M2 is stopped, the microprocessor outputs a voltage to contactor con 100 to start doffing rail motor M1 to descend doffing rail down at slow speed to sensor B thereby passing the open grippers over the (rims) 30 of the empty bobbin tubes.

(xii) On receipt of a signal from sensor 'B' the microprocessor stops outputting a voltage to contactor con 100 and thereby stops motor M1 to stop the descent of rail 14. At the same time, the microprocessor sends a voltage to solenoid 162 of valve 400 to inflate tube 52 and close the grippers around the necks 62 of the bobbin tubes.

(xiii) After a pre-programmed brief pause to permit the tube to be inflated to ensure that the grippers are fully closed around the necks of the bobbin tubes, the microcomputer outputs a voltage to contactor con 100 so that motor M1 restarts and the doffing rail moves down at slow speed so as to pull the bobbins gently off the spigots 10 of conveyor 4, to sensor C.

(xiv) On receipt of a signal from sensor C the microcomputer stops outputting a voltage to contactor con 100 and instead outputs a voltage to contactor con 6 thereby switching motor M1 to fast speed, and so doffing rail moves down at fast speed to sensor D.

(xv) On receipt of a signal from sensor D the microprocessor stops outputting a voltage to contactor con 6 thereby stopping motor M1 to stop the descent of rail 14. The microprocessor also stops outputting a voltage to solenoid 162 of valve 400 to enable the air to exhaust from tube 52 so as to open grippers and permit the bobbin tubes to fall onto the spindles.

(xvi) After a pre-programmed pause to allow bobbin tubes to drop onto the spindles, the microprocessor outputs a voltage to contactor con 5 and motor Ml restarts in the reverse direction and doffing rail moves up at fast speed to sensor C. On receipt of a signal from sensor C, the microprocessor outputs a voltage to contactor con 101 instead of con 5 to reduce speed of motor M1 and hence slow the ascent of the doffing rail.

On receipt of the sensor C signal the microprocessor also outputs a voltage to contactor con 10 and so operates a motor M6 to rotate shaft 164 (FIG. 1) so as to cause fingers 168 to engage the tops 65 of the bobbin tubes on the twisting spindles to locate them fully on the spindles. When the fingers 168 have reached the end of their movement a limit switch 170 is engaged. On receipt of the signal from this limit switch the microprocessor outputs a voltage to contactor con 9 instead of con 10 so reversing motor M6 to return shaft 164 to its inoperative position (FIG. 1) where a further limit switch 172 is engaged to provide a signal to the microprocessor to stop the output voltage to contactor con 9, so stopping motor M6.

(xvii) Meanwhile when the ascending doffing rail reaches the park position, sensor A signals the microprocessor to stop sending an output voltage to contactor con 101 and so stops motor M1 with the doffing rail 14 at the park position. This is the end of the auto doff-/donn sequence and the microprocessor next moves into the bobbin unload sequence as described in Stage 2.

The microprocessor also resets the yardage counter 300 and restarts the machine on the next spinning cycle. A function of the microprocessor is the control of the spinning cycle which is not described in detail in the specification as the present invention is related to the auto doffing of the full bobbins and donning of the empty bobbins when the spinning cycle has been completed.

STAGE 2

(i) On completion of the auto-doff sequence, when the microprocessor receives a signal from sensor A (as described in step (xvii) of Stage 1), after a pre-programmed brief pause, the microprocessor sends an output voltage to contactor con 12 and so causes motor M2 to run the top conveyor 4 (slow) in an anti-clockwise direction so as to bring the full bobbins 125 from the top run of the top conveyor 4 around to the bottom run to the position of the bobbin unloading device illustrated in FIGS. 9 and 10.

(ii) On receipt of the signal from sensor A, the microprocessor also outputs a voltage to contactor con 102 starting a motor M3 which drives the pallet moving mechanism, illustrated in FIG. 9, if there is no signal from a sensor K which is activated by the presence of a row of pins 146 of the pallet 144.

(iii) If pallet 144 is not properly positioned with the leading row of pins 146 located beneath the six grippers of the unloading rail so that a signal is not received from sensor K, the motor M3 drives the pallet forward to the start position where a locator on the side of the pallet in line with the first row of pins cooperates with the sensor K and as soon as a signal from sensor K is received by the microprocessor it stops sending an output voltage to contactor con 102, thereby causing the motor M3 to stop the forward movement of the pallet. (If the pallet was already in the correct starting position then the signal from sensor K to the microprocessor would have meant that the microprocessor would not have provided a voltage to contactor con 102 and so motor M3 would not have started).

(iv) The top conveyor 4 continues to rotate until a sensor J which is positioned along the path of the bottom run 4'' of the conveyor (FIG. 1) and in line with the axis of the first pin of the pallet, sends a total of six signals to the microprocessor caused by the passing of six full bobbins on conveyor 4, whereupon the microprocessor stops outputting a voltage to contactor con 12 and so cause motor M2 to stop the top conveyor 4.

(v) The microprocessor 160 then, after a preprogrammed brief pause, outputs a voltage to contactor con 104 thereby causing the motor M4 to drive the unload grippers support rail 138 from the park position adjacent sensor N to sensor 0 and in so doing lower the open grippers 16' of the bobbin unloading apparatus over the rims 65 of the six leading bobbins on the conveyor 4. Sensor 0 signals the microprocessor to stop outputting a voltage to contactor con 104 to stop motor M4 and arrest the rail 138 at sensor 0.

(vi) Also on receipt of the signal from sensor 0, the microprocessor sends an output voltage to solenoid 174 of a 3-port spring return pneumatic valve 401 which is connected to a compressed air supply on its inlet side and the unload rail inflatable tube on its outlet side. This causes the unload rail tube to inflate to close the grippers 16' around the neck of the six bobbins.

(vii) After a pre-programmed brief pause the microprocessor again outputs a voltage to contactor con 104 thereby causing motor M4 to start to move the unload rail 138 down and pull the six full bobbins off their respective spigots 10 of conveyor 4.

(viii) When the unload rail arrives adjacent sensor P, a signal is sent from sensor P to the microprocessor which then stops sending an output voltage to contactor con 104 causing motor M4 to stop the descent to the unload rail.

(ix) Also on receipt of the signal from sensor P the microprocessor stops outputting a voltage to solenoid 174 of valve 401 and the air is exhausted from the tube to open the grippers 16' to release the six bobbins on to the first row of pins on the pallet 144.

(x) After a pre-programmed brief pause, the microprocessor outputs a voltage to contactor con 105 causing Motor M4 to start and drive the unload rail 138 back up to the park position adjacent sensor N. - A signal is sent from sensor N which signals the microprocessor to stop sending an output voltage to contactor con 105 causing motor M4 to stop the ascent of rail 138.

(xi) Also on receipt of the signal from sensor N the microprocessor sends an output voltage to contactor con 102 and so causes the pallet conveyor motor M3 to start so as to move the pallet forward until the sensor K detects that the next row of pins are below the grippers 16' causing a signal to be sent from sensor K to the microprocessor which then stops sending an output voltage to contactor con 102 thereby stopping motor M3 and arresting the pallet in position with the next row of pins 146 ready to receive the next six bobbins.

(xii) On receipt of the signal from sensor N the microprocessor also sends an output voltage to contactor con 12 causing the motor M2 to start to run the top conveyor anti-clockwise and after six more full bobbins have passed sensor J. resulting in six more signals from sensor J to the microprocessor, the output voltage to contactor con 12 is stopped and so the motor M2 stops with the next six bobbins on conveyor 4 positioned ready to be unloaded onto the pallet.

(xiii) The latter half of step (xii) above is a repeat of step (iv) and signifies that the next unloading sequence has commenced whereupon steps (iv) through (xii) are repeated until all the full bobbins have been unloaded onto the pallets which are replaced each time one is filled. When the microprocessor has registered the full quota of bobbins, via cumulation of the signals from sensor J (the value of said full quota being preprogrammed in the microprocessor), from step (xii), signifying the end of the bobbin unload, it outputs a voltage to contactor con 12 causing motor M2 to move the top conveyor 4 until the sensor R detects a locator T, which is carried by an appropriately positioned bracket 8 on the top conveyor 4. Sensor R then sends a signal to the micro-processor which stops sending an output voltage to contactor con 12 causing the motor M2 to stop the conveyor in readiness for the bobbin tube loading sequence as described in Stage 3, signifying the completion of the bobbin unload programme.

STAGE 3

(i) On the completion of the full bobbin unload sequence as described in Stage 2, when the new bobbins being wound on the spinning spindles have reached a certain stage (length) in their formation, a sensor U (shown in FIG. 3) detects a locator V on the end of a ring rail 126 and sends a signal to the microprocessor 160 which outputs a voltage to contactor con 12 and so starts the motor M2 to drive the top conveyor 4 anticlockwise.

(ii) When a sensor H which is positioned along the path of the bottom run 4'' of the top conveyor 4 and in line with the bifurcated bobbin tube lifting member 116, detects the arrival of the first spigot 10 of conveyor 4 a signal is sent from sensor H to the microprocessor which then stops sending an output voltage to contactor con 12 to stop motor M2 and conveyor 4.

(iii) Also on receipt of the signal from sensor H the microprocessor intermittently sends an output voltage to solenoid 147 of a 3-port spring return pneumatic valve 402 connected at its inlet side to a compressed air supply and on its outlet side to pneumatic cylinders 86, 88 which reciprocate the plate 82 of the bobbin tube hopper 70 to ensure that the bobbin tubes do not jam as they move to the exit 80 of the hopper in preparation for being pushed onto a spigot 100 of the vertical loading conveyor 72.

The cylinders 86, 88 are operated continuously in this manner throughout the bobbin load sequence.

(iv) On receipt of the signal from sensor H the microprocessor also outputs a voltage to contactor con 16 to start motor M5 which drives the vertical conveyor 72 in a clockwise direction.

(v) When a spigot 100 of the vertical conveyor arrives at sensor Z which, as shown in FIG. 5, is positioned in line with the bobbin tube to be pushed onto the spigot, a signal is sent from sensor Z to the microprocessor which then stops outputting a voltage to contactor con 16 causing motor M5 to stop the travel of the vertical loading conveyor 72.

(vi) After a pre-programmed short pause and provided that sensor L (FIG. 7) sends a signal to the microprocessor indicating that the metal rim 65 of the bobbin tube is at the correct side of the hopper (remote from the spigot 100), the microprocessor sends an output voltage to solenoid 176 of a 5-port spring return pneumatic valve 403 which is connected on its inlet side to a compressed air supply source and on its outlet side to a double-acting pneumatic cylinder 104. This causes the double acting pneumatic cylinder 104 to operate to retract its piston 106 to pull the aligned bobbin tube onto the opposing spigot 100 of the vertical conveyor 72. The microprocessor then stops outputting a voltage to solenoid 176 of valve 403 causing the double-acting cylinder 104 to advance its piston and return to the ready position shown in FIGS. 5 and 6.

In the event that the bobbin tube is not positioned with the rim 65 remote from the spigot of the vertical hopper, no signal is sent from sensor L to the microprocessor and as a result the microprocessor sends an output voltage to solenoid 78 of a 3-port spring return pneumatic valve 404 which is connected on its inlet side to a compressed air supply and on its outlet side to a pair of pneumatic cylinders 110, 112 which operate to eject the wrongly positioned bobbin. The microprocessor then stops outputting a voltage to solenoid 178 of valve 404 and cylinders 110, 112 retract and allow the next correctly positioned bobbin to move into place at the exit 80 of the hopper 70.

(vii) The microprocessor then outputs a voltage to contactor con 16 and so start the motor M5 as per the latter part of step (iv) to drive the vertical conveyor to align the next spigot 100 with the exit 80 of the hopper.

(viii) Steps (iv) through (vii) are repeated until the first tube to be loaded on the vertical conveyor comes into line with a sensor G (FIG. 8) which is aligned with the bifurcated lifting member 116 whereupon a signal is sent from sensor G to the microprocessor which in turn stops sending an output voltage to contactor con 16 to cause motor M5 to stop the vertical conveyor 72.

(ix) Also on receipt of the signal from sensor G, the microprocessor sends an output voltage to a solenoid 239 of a 3-port spring return pneumatic valve 405 which is connected on its inlet side to a compressed air supply and on its outlet side to a pneumatic cylinder 118 which carries the bifurcated lifting member 116 to operate the cylinder to extend the piston to locate the forks of the member 116 around the neck 62 of the bobbin tube 64.

(x) After a preprogrammed slight pause the pneumatic cylinder 120, which carries the pneumatic cylinder 118 is operated when the microprocessor sends an output voltage to a solenoid 180 of a 3-port spring return pneumatic valve 406 connected in its inlet side to a compressed air supply and on its outlet side to the cylinder 120, so as to operate its cylinder to lift the bobbin tube up onto the opposite spigot 10 of the conveyor 4.

(xi) After a further pre-programmed pause the microprocessor stops sending an output voltage to solenoid 239 thereby causing cylinder 118 to withdraw the bifurcated member from the neck of the tube on the spigot.

(xii) After a still further pre-programmed pause the microprocessor stops sending an output voltage to solenoid 180 thereby causing cylinder 120 to lower the cylinder 118 and hence the bifurcated member 116 to the inoperative position shown in FIG. 8.

(xiii) The microprocessor then outputs a voltage to contactor con 12 which causes motor M2 to restart and move the conveyor 4 to bring the next spigot into line with the sensor H whereupon a signal is sent from sensor H to the microprocessor which in turn stops outputting a voltage to contactor con 12 so causing motor M2 to stop. At the same time the microprocessor sends another output voltage, in this instance, to contactor con 16 and so motor M5 restarts to drive the vertical conveyor 72 so as to bring the next spigot 100 into line with the sensor Z and the bobbin tube at the exit 80 of the hopper 70, whereupon a signal is sent from sensor Z to the microprocessor which in turn stops outputting a voltage to contactor con 16 so stopping motor M5 and conveyor 72.

(xiv) The microprocessor repeats step (vi) to push the bobbin tube onto the spigot 100.

(xv) The movement of the vertical conveyor 72 also brings the next leading bobbin tube into line with sensor G. Receipt of a signal from sensor G by the microprocessor results in the microprocessor repeating steps (ix), (x), (xi) and (xii) to effect the operation of the cylinders 118 and 120 to lift the next bobbin tube as described in steps (xiii) and (xiv) onto the spigot 10 of the top conveyor 4.

(xvi) This sequence is repeated until all the empty bobbin tubes have been loaded onto the top conveyor.

(xvii) When the full complement of bobbins have been loaded the microprocessor which has registered the total number of tubes by repeated receipt of signals from sensor G (the number of bobbin tubes coinciding with the number of twisting spindles and being pre-programmed), outputs a voltage to contactor con 12 which starts the motor M2 to drive the conveyor 4 until the empty bobbins are extending upwardly from the top run of conveyor 4 whereupon locator S is sensed by sensor R which sends a signal to the microprocessor which in turn stops outputting a voltage to the contactor con 12 causing motor M2 to stop conveyor 4 so that the empty spigots on the bottom run are above and in line with the twisting spindles in preparation for the completion of the spinning cycle and next auto doff sequence.

Stage 2 and 3 are, of course, effected while the spinning machine is in operation and the yarn is being wound onto the bobbins on the twisting spindles.

What I claim is:

1. A yarn spinning, twisting or doubling machine comprising bobbin doffing and donning apparatus for the spindles of the machine, the apparatus comprising bobbin conveying means extending along and above a row of spindles in the same vertical plane as said spindles, a series of bobbin grippers corresponding to said row of spindles spaced at the same pitch as the spindles and disposed in the same vertical plane as said conveying means and said spindles, each gripper being mounted for vertical movement between its corresponding spindle and the conveyor, each gripper being designed to hold or grip a bobbin at a point beyond one end of a package wound on the bobbin so that the grippers can lift the wound bobbin from its spindle for engagement by means on the conveyor and then release the bobbin for subsequent removal, or grip an empty bobbin on the conveyor and move it to its respective spindle and control means operable to move the conveyor after it has received the full doffed bobbins and to bring empty bobbins into line with the spindles so that the grippers can place empty bobbins on the spindles.

2. A machine as claimed in claim 1 in which the grippers are arranged to move axially over the end of a bobbin prior to closure to grip or hold the bobbin.

3. A machine as claimed in claim 1 or 2 in which the conveyor has projections on which wound or empty bobbins may be held, the pitch of the projections corresponding with that of the spindles and the grippers.

4. A machine as claimed in claim 2 in which each gripper has two relatively movable arms, the outer end of each arm being so shaped and dimensioned that when the gripper is closed the said outer ends can encircle or party encircle a bobbin to trap the bobbin within the encircling ends and so that in the open position the said arms can pass over the end of a bobbin.

5. Apparatus as claimed in claim 4 in which the arms are pivotally connected at their inner ends, the opposing encircling faces of the outer ends of the arms lying at an angle to the pivotal axis.

6. A machine as claimed in claim 4 further including control means which causes the gripper arms to open to release an empty bobbin during donning before the bobbins are fully located on the spindles so that the bobbins drop freely during at least part of their movement over the spindles.

7. A machine as claimed in claim 6 further including control means to close the gripper arms during a part of the vertical movement between the conveyor and a full bobbin on a spindle so as to prevent the yarn which extends from the delivery rollers to the wound package from entering a gripper during its descent towards the wound bobbin.

8. A machine as claimed in claim 1 further including a member positioned adjacent each spindle which, during the normal spinning, twisting or doubling operation is in an inoperable position clear of the bobbin but which can be moved so as to engage the bobbin on the spindle during the doffing and/or donning operation.

9. A machine as claimed in claim 8 in which said member is caused to engage the top of an empty bobbin after it has been donned on the spindle so as to seat the bobbin on the spindle.

10. A machine as claimed in claim 1 or 6 further including supports for carrying the grippers, said supports mounted for movement in a vertical direction on pillars, and control means being provided to control the vertical movement and position of the gripper support during the doffing and donning sequence.

11. A machine as claimed in claim 10 having control means to cause, prior to the completion of the winding of the yarn packages on bobbins on the spindles, the conveyor to be brought to a position in which projections along its bottom run are aligned with the respective twisting spindles in preparation of the doffing operation while the other projections carry empty bobbins in preparation for being moved to and above the spindles after the full bobbins are doffed and ready for the donning operation.

12. A machine as claimed in claim 11 further including a bobbin unloading station, the station having anumber of bobbin grippers at the saem pitch as the full bobbins carried by the bobbin conveyor, the conveyor being movable so as to bring a number of bobbins in line with the respective grippers, each gripper being designed to hold or grip a bobbin adjacent one end thereof and being movable vertically between a bobbin on the conveyorand a discharge position and control means to cause each gripper to grip or hold a bobbin on the conveyor and to move it to the said discharge position whereupon the grippers are caused to release their respective bobbins and move back to the conveyor ready to grip a further bobbin, the conveyor being indexed after each full batch of bobbins have been unloaded to the discharge position so as to move a further batch of full bobbins into position to be engaged by the grippers.

13. A machine as claimed in claim 12 in which a pallet is provided beneath the conveyor at the unloading station to receive full bobbins from the conveyor, the pallet being provided with bobbin locating means to locate the lower ends of the bobbins being lowered thereon by the grippers.

14. A machine as claimed in claim 13 in which means are provided to move the pallet from the bobbin receiving position after discharge of a batch of bobbins so as to present unused additional bobbin locating means in a position ready to receive a further batch of bobbins.

15. A machine as claimed in claim 14 in which the underside of the pallet has recesses pitched to coincide with the pitch of the bobbins locating means, pushers being provided on a driven belt to engage in the recesses and move the pallet when desired.

16. A machine as claimed in claim 15 having a station at which empty bobbins are loaded onto the conveyor and a station at which wound bobbins are removed therefrom, the bobbin unloading and loading stations being located at the same end of the machine.

17. A bobbin tube for use in a machine as claimed in claim 1 having a through bore and an elongated neck terminating in an annular collar at its end of the smallest diameter, or a projection or projections similarly located, so as to enable the encircling arms of a bobbin gripper to hold and lift a bobbin by encircling a bobbin beneath the collar or the projections.

* * * * *